US006955532B2

(12) United States Patent
Zhu et al.

(10) Patent No.: US 6,955,532 B2
(45) Date of Patent: Oct. 18, 2005

(54) METHOD AND APPARATUS FOR THE MANUFACTURE OF HIGH TEMPERATURE MATERIALS BY COMBUSTION SYNTHESIS AND SEMI-SOLID FORMING

(75) Inventors: Ping Zhu, Pittsford, NY (US); James C. M. Li, Pittsford, NY (US)

(73) Assignee: University of Rochester, Rochester, NY (US)

( * ) Notice: Subject to any disclaimer, the term of this patent is extended or adjusted under 35 U.S.C. 154(b) by 194 days.

(21) Appl. No.: 10/254,244

(22) Filed: Sep. 25, 2002

(65) Prior Publication Data

US 2004/0057861 A1 Mar. 25, 2004

(51) Int. Cl.[7] ..... B22F 3/14
(52) U.S. Cl. ..... 425/78
(58) Field of Search ..... 419/45, 48; 425/78

(56) References Cited

U.S. PATENT DOCUMENTS

| | | | | |
|---|---|---|---|---|
| 3,948,650 A | | 4/1976 | Flemings et al. | |
| 3,954,455 A | | 5/1976 | Flemings et al. | |
| 4,229,210 A | | 10/1980 | Winter et al. | |
| 4,310,352 A | | 1/1982 | Manfre et al. | |
| 4,415,374 A | | 11/1983 | Young et al. | |
| 4,642,218 A | | 2/1987 | Rice | |
| 4,762,558 A | * | 8/1988 | German et al. | 75/246 |
| 4,879,262 A | * | 11/1989 | Halverson et al. | 501/87 |
| 4,909,842 A | | 3/1990 | Dunmeah et al. | |
| 4,946,643 A | | 8/1990 | Dunmead et al. | |
| 4,988,645 A | * | 1/1991 | Holt et al. | 501/91 |
| 4,990,180 A | * | 2/1991 | Halverson et al. | 75/239 |
| 5,114,645 A | | 5/1992 | Niiler et al. | |
| 5,141,776 A | * | 8/1992 | Merzhanov et al. | 427/255.38 |
| 5,188,678 A | * | 2/1993 | Sekhar et al. | 148/514 |
| 5,342,572 A | | 8/1994 | Stangle et al. | |
| 5,381,847 A | | 1/1995 | Ashok et al. | |
| 5,382,405 A | | 1/1995 | Lowrance, II et al. | |
| 5,708,956 A | | 1/1998 | Dunmead et al. | |
| 5,794,113 A | | 8/1998 | Munir et al. | |
| 6,001,304 A | | 12/1999 | Yoo et al. | |
| 6,068,043 A | | 5/2000 | Clark | |

FOREIGN PATENT DOCUMENTS

JP 11-131106 5/1999

OTHER PUBLICATIONS

Zuhair A. Munir and Umberto Anselmi–Tamburini, Self Propagating Exothermic Reactions: The Synthesis of High–Temperature Materials by Combustion, Materials Science Reports, (1989), pp. 279–365, vol. 3, Division of Materials Science and Engineering, College of Engineering, University of California, Davis, California.

(Continued)

*Primary Examiner*—Daniel Jenkins
(74) *Attorney, Agent, or Firm*—Stephen B. Salai, Esq.; Donna P. Suchy, Esq.; Harter, Secrest & Emery LLP

(57) ABSTRACT

An apparatus and method of producing dense, near net shape components of advanced materials such as intermetallics, ceramics, and their composites. The method consists of two major steps combined into one. First step includes the preparation of semi-solid or liquid materials by means of combustion synthesis or self-propagating high-temperature synthesis. The second step includes the densification and near net shape forming of such combustion products by semi-solid metalworking or die casting techniques. The combination of combustion synthesis and semi-solid metalworking or die casting techniques provides a low cost, fast production method for many articles made of high temperature materials such as intermetallics, ceramics, and their composites.

17 Claims, 9 Drawing Sheets

OTHER PUBLICATIONS

J. B. Holt and S. D. Dunmead, Self–Heating Synthesis of Materials, Annu. Rev. Matter. Sci., (1991), pp. 305–334, University of California, Lawrence Livermore National Laboratory, Livermore, California, and Dow Chemical, Midland, Michigan.

John J. Moore and H. J. Feng, Combustion Synthesis of Advanced Materials: Part I. Reaction Parameters, Progress in Materials Science, (1995), pp. 243–273, vol. 39, Department of Metallurgical and Materials Engineering, Colorado School of Mines, Golden, Colorado.

John J. Moore and H. J. Feng, Combustion Synthesis of Advanced Materials: Part II. Classification, Applications and Modelling, Progress in Materials Science, (1995), pp. 275–316, vol. 39, Department of Metallurgical and Materials Engineering, Colorado School of Mines, Golden, Colorado.

A. Varma and A. S. Mukasyan, Combustion Synthesis of Advanced Materials, ASM Handbook, (1998), pp. 523–540, vol. 7, Metal Powder Technologies and Applications, W.B. Eisen, B.L. Ferguson, R.M. German, Ed., ASM International.

Zhu, Ping, J.C.M. Li & C.T. Liu, "Reaction Mechanism of Combustion Synthesis of NIAI", journal (*Elsevier Science*, Material Science and Engineering A329–331 [2002] 57–68).

* cited by examiner

The liquid fraction in semisolid product $Ni_3Al$ as it varies with the initial reaction temperature Effect of amount of $Ni_3Al$ addition on liquid fraction in reaction product a---initial reaction temperature $T_i$ 833K b---$T_i$ 932K, c---$T_i$ 934K Effect of $Al_2O_3$ addition on liquid fraction in $Ni_3Al$ combustion synthesis for an initial reaction temperature of 932K Temperature history of 3Ni+Al system which undergoes combustion synthesis

X50

Micrograph of polished product, showing dense $Ni_3Al$ with small amount of oxide strings

X400

Micrograph of polished product, showing dense $Ni_3Al$ with small amount of oxide strings

X50

Micrograph of polished sample produced by combustion synthesis only (without semi-solid forming), showing the existence of voids

X100

Microstructure of $Al_2O_3/Ni_3Al$ composite

X100

Microstructure of $ZrO_2/Ni_3Al$ composite

X400

Microstructure of $ZrO_2/Ni_3Al$ composite

METHOD AND APPARATUS FOR THE MANUFACTURE OF HIGH TEMPERATURE MATERIALS BY COMBUSTION SYNTHESIS AND SEMI-SOLID FORMING

FIELD OF THE INVENTION

The present invention relates to the production of high temperature materials such as intermetallics, ceramics and ceramic-metallic composites and the like. More particularly the present invention relates to a method comprising a combination of combustion synthesis and semi-solid forming to produce shaped articles composed of such materials.

BACKGROUND OF THE INVENTION

A conventional method for producing a molded metallic article involves melting the raw material and then casting the molten metal to form a shaped article. Typically, the cast article is subjected to a machining operation afterwards to give the final shape.

However, some materials such as intermetallics, ceramics and their composites referred to herein as high temperature materials melt at such high temperatures that conventional melting and casting methods are difficult or even impossible to use. Though conventional melting and casting methods are applicable to some intermetallic materials, often it is difficult to control the chemical composition of the cast material because of the large differences in melting temperatures and vapor pressures of the constituent elements of the intermetallic. For example, in the case of an intermetallic such as TiAl, the melting points of Titanium and Aluminum are 1668° C. and 660° C. respectively. Also the microstructure of the cast article may not be satisfactory because of the formation of large grains, dendrites and the chemical heterogeneity of the casting components. To obtain a desired microstructure of the cast article, post-casting operations are often required such as hot plastic deformation processes, including forging, rolling or extrusion.

Cast high temperature materials are extremely hard and are difficult to process by hot deformation. Accordingly, the manufacture of a shaped or formed article from these materials by melting, casting and machining is very difficult and expensive.

Powder metallurgy can be used to form sintered articles of high temperature materials. Use of powder metallurgy overcomes the problems caused by the chemical composition and lack of homogeneity of the constituents, but the products usually contain lots of voids. To densify the sintered products, long period hot pressing, or isostatic hot pressing, or heavily hot plastic deformation is required. This greatly increases the cost and production cycle of components.

Another alternative to a conventional casting and forging methods is a semi-solid forming process. Semi-solid forming is an advanced manufacturing method that is used to produce near net shape metal components in place of traditional casting and forging methods. In semisolid forming, a metal billet is brought to a thixotropic state and then formed to a desired shape, sometimes called a shaped component, by forging, extrusion or pressure die casting. The semi-solid forming can be a "rheoforming" or "rheocasting", in which a semi-solid slurry is produced from liquid state under specific conditions, then directly delivered to a die for forming. Normally in this process 60 to 70% of the material is liquid. The semi-solid forming can also be a "thixoforming", in which a specially prepared solid billet is heated to the semi-solid state, then delivered to and formed in a die. In this process, usually 30 to 40% of the material is liquid. A metal in a thixotropic state means that about 30 to 40% of the metal mass is in a liquid phase and the rest is in a solid phase and the solid phase comprises round shaped nodules suspended in the liquid phase.

In a thixotropic state, a metal exhibits unique rheological properties. In this respect the metal has a high viscosity at rest and a low viscosity when subjected to a high shear rate such as during a shaping process like forging or die casting. Accordingly, a thixotropic billet having a high viscosity at rest will retain its outer shape, therefore it can be easily handled and manipulated without substantial deformation. The low viscosity created by a shearing action then allows the billet to be shaped. This low viscosity property makes such a billet extremely suitable for a shaping process like forging or die casting.

Semisolid forming has many advantages over conventional casting. It allows lower operating temperatures and reduced-heat content which, in turn, results in reduced solidification shrinkage, less shrinkage porosity and longer life of the shaping die. Viscous flow of the semisolid materials during the filling of a die cavity results in low gas entrapment and low porosity of the resulting article. Semisolid forming has a relatively short process cycle so that automation of the process can result in high productivity. Precision dies may be used in the process so that the resulting article is close to a final shape requiring little machining. Compared to conventional forging, semisolid forming requires less shaping energy and the liquid-like flowability of the material allows the formation of complex shapes.

The current semi-solid forming technology has its drawbacks. These include the requirement for specially prepared starting material. The key to the semisolid forming is the round non-dendritic microstructure of the starting material. To obtain a suitable microstructure of the starting material, an additional process is required to break up the inherent dendritic microstructure of billets. For example, vigorous agitation processes, which were disclosed in U.S. Pat. No. 3,948,650, U.S. Pat. No. 3,954,455, U.S. Pat. No. 4,310,352 (mechanical stirring) and U.S. Pat. No. 4,229,210 (inductive electromagnetic stirring), were used to break up dendritic microstructure during billet casting.

Instead of vigorous agitation processes, a "SIMA" (strain induced, melt activated) process which was disclosed in U.S. Pat. No. 4,415,374 was used to make starting materials for semi-solid forming. In this process, a conventionally solidified and homogenized ingot was hot deformed, then cold deformed to obtain a directional grain structure. When the deformed material was reheated to a temperature above the solidus and below the liquidus, a semi-solid material with uniform discrete round particles and liquid matrix was formed.

A process called "nucleated casting" which was disclosed in U.S. Pat. No. 5,381,847 and U.S. Pat. No. 6,068,043 was also used to make semi-solid forming starting materials. In this process, metal liquid was sprayed in a non-reactive gas environment to form droplets. The partially solidified droplets were then collected to form a billet which was suitable for semi-solid forming.

An additional drawback of current semisolid forming technology is the high cost of starting materials because of the additional process required to form the round non-dendritic microstructure. Although the nature of semisolid forming makes it an ideal process for the manufacture of high melting temperature alloys such as superalloys, tool steels and intermetallic materials that are difficult to shape by conventional means, the technique currently is commercially limited to production involving only certain aluminum and magnesium alloys.

High melting temperature starting materials which are suitable for semi-solid forming might be produced requiring special and expensive capital equipment. For example, an induction-heating element with an accurate temperature control system is used to heat the billet to a semisolid state. In order to form the desired liquid fraction, the temperature of the billet often is required to be within ±5° C. or even ±2° C. of a desired value throughout the whole billet. This makes temperature control difficult and complicated. For high melting temperature materials, temperature control of the billet is even more difficult.

Another method for manufacture of high temperature materials involves combustion synthesis or self-propagating high-temperature synthesis (SHS). In combustion synthesis, reactant powders are mixed and pressed to form a compact. The compact then is ignited to trigger a combustion reaction. Highly exothermic reactions between reactant powders result in high temperature reaction products. Immediately after the exothermic reaction, the temperature of the resulting product is often equal to or higher than the melting temperature so the product of the reaction often is in a liquid or semisolid state.

One primary objective of the present invention is to manufacture high temperature material products by taking advantage of high rate of production, near-net shaping capability, low operation temperature of semi-solid forming techniques. Another objective is to take advantage of combustion synthesis techniques to bring a billet to a semi-solid state, therefore overcome the various above-mentioned limitations of semi-solid forming techniques.

The combustion synthesis technique and its prospects have been discussed in several recent review papers (1, Zuhair A. Munir and Umberto Anselmi-Tamburini, Materials Science Reports, Vol. 3(1989), p 279; 2, J. B. Holt and S. D. Dunmead, Annu. Rev. Mater. Sci., Vol. 21(1991), p 305; 3, John. J. Moore and H. J. Feng, Progress in Materials Science, Vol. 39(1995), p 243, 275; 4, A. Varma and A. S. Mukasyan, in ASM Handbook Volume 7: Metal Powder Technologies and Applications, W. B. Eisen, B. L. Ferguson, R. M. German, Ed., ASM International, 1998, p 523).

As compared to other methods of materials preparation, the advantages of combustion synthesis include: 1) a low energy requirement; 2) fast reaction rate and short reaction time; 3) relative simplicity of the process; and 4) easy introduction of reinforcements in the preparation of composites either by in situ formation of a second phase or by the addition of an inert second phase to the reactants. However, a major problem of combustion synthesis is that the resulting products are generally porous. Accordingly, combustion synthesis generally is limited to the production of powder materials. In order to obtain a dense material for components and structural applications by combustion synthesis, the products must be densified.

To this end various densification techniques are employed to eliminate the porosity of combustion synthesis products. Among them, pressure assisted densification is a most efficient and popular method. Several variations of the pressure assisted densification techniques have been developed. These include:

1) hot pressing or hot isostatic pressing during or immediately after combustion synthesis, as seen in U.S. Pat. Nos. 4,909,842, 4,946,643, 5,342,572, 5,382,405, 5,708,956, 5,794,113, 6,001,304, and JP 11131106;
2) high speed shock-wave pressing, as seen in U.S. Pat. No. 5,114,645, L. J. Kecskes, T. Kottke, A. J. Niiler, J. Am. Ceram. Soc., Vol 73(1990), p1274, B. H. Kabin, G. E. Korth, R. L. Williamson, Int. J. SHS, Vol 1(1992), p336; and
3) hot rolling or extrusion after combustion synthesis, as seen in U.S. Pat. No. 4,642,218, V. V. Podlesov, A. V. Radugin, A. M. Stolin, A. G. Merzhanov, J.Eng. Phys. Thermophys., Vol 63 (1992), p1065.

All the techniques listed above have serious disadvantages. All methods are limited to producing simple shape products. A product having a shape which requires little or no subsequent machining is difficult to obtain by these methods except by hot pressing and hot isostatic pressing. However, hot pressing and hot isostatic pressing require long processing time and high processing temperature in order to obtain low porosity products. These processes generally require additional external heating to maintain reaction products at high temperatures. The requirements of long pressing time and additional heating detract from the advantages of combustion synthesis, these advantages being high speed and low energy requirement.

Accordingly, it is an object of the present invention to provide a method for manufacturing an article composed of high temperature materials that is sufficiently close to a desired shape as to require little or no subsequent machining.

Another object of the present invention is to provide a method for manufacturing articles of high temperature materials utilizing a semisolid forming process.

A further object of the present invention is to provide a method for manufacturing an article composed of a high temperature material wherein combustion synthesis is used to bring a billet to a semisolid state for forming to the desired shape.

Yet another object of the present invention is to provide an apparatus for forming an article composed of high temperature materials.

SUMMARY OF THE INVENTION

In accordance with the method of the present invention, an article is formed of dense high temperature materials wherein the article is, or is close to, a desired shape so as to require little or no subsequent machining. The method provides for the formation of the article from a mixture comprising powered reactants that are capable of undergoing a highly exothermic reaction. The mixture may include alloying elements or reinforcements. In the method, the powered mixture first is compressed to form a simple shaped billet. The billet then is ignited to initiate a combustion synthesis reaction. The resulting combustion product is controlled to be in a semisolid state. Immediately after combustion reaction, the semisolid product of the reaction is processed by any suitable semisolid metalworking technique such as forging, pressure die-casting or the like to increase the product density and shape the article.

The method of the present invention relies on both combustion synthesis and semisolid forming to produce an article of high temperature material that is, or is close to, a desired shape requiring little or no subsequent machining. Combining combustion synthesis and semisolid forming according to the present invention provides the advantages of low energy requirements, and a short production cycle, forming an article requiring little or no subsequent machining, and high density fine microstructure products composed of intermetallics, ceramics and their composites.

Accordingly, the invention may be characterized in one aspect thereof by a method for making shaped articles of high temperature materials comprising the steps of:

a) mixing solid powdered reactants to provide a mixture capable of undergoing a combustion synthesis reaction to form a semisolid product;

b) compressing the mixture to form a green compact;

c) initiating the combustion synthesis of the green compact to form a semisolid; and d) subjecting the semisolid to forming pressure for converting the semisolid to a desired shape.

In another aspect, the invention is a method for making near shape and dense components that are, or are close to, a desired shape by means of the combination of combustion synthesis and semisolid forming which comprises:

a) mixing solid powder reactants which can undergo a combustion reaction to form a semisolid product;

b) compressing the powder mixture to form a green body or compact of desired shape;

c) placing the compact in the reaction chamber of a semisolid metalworking machine such as pressure die casting machine or forging machine;

d) initiating the combustion synthesis either in a thermal explosion mode or self-propagating high-temperature synthesis mode; and e) shaping and densifying the combustion products by injecting or pressing the semisolid products into the mold.

In another aspect, the present invention may be characterized by apparatus for making an article composed of high temperature materials comprising:

a) means for providing a green compact composed of powdered reactants capable of undergoing a combustion synthesis reaction;

b) heating means for initiating the combustion synthesis of the green compact to form a semisolid; and c) press means for forming the semisolid to a desired shape.

The invention further is a method as noted above wherein the product produced by combustion synthesis is in a semisolid state prior to shaping or wherein the shaping and densification procedures are started right after the completion of combustion synthesis but before the semisolid completely solidifies. The time for initiating the shaping could be within 10 seconds after the reaction system reaches the maximum reaction temperature and the injecting or pressing speed or machine ram moving speed during the shaping step is faster than 10 mm/s. It also is possible to conduct the combustion synthesis, shaping and densification processes in vacuum with pressure lower than 1 Torr.

Some typical articles which may be made according to the method and apparatus of the present invention are titanium aluminide based alloy engine valves.

The solid phase existing in the semisolid product of the combustion synthesis may have a granular shape which is uniformly distributed in the liquid fraction and comprise generally 30–90 vol % of the liquid fraction although it may vary outside this range. The liquid fraction in the product may be controlled by changing the initial reaction temperature and/or the content of the non-reaction additives such as alloying elements, diluents, and reinforcements.

DETAILED DESCRIPTION OF THE INVENTION

Figure 1:
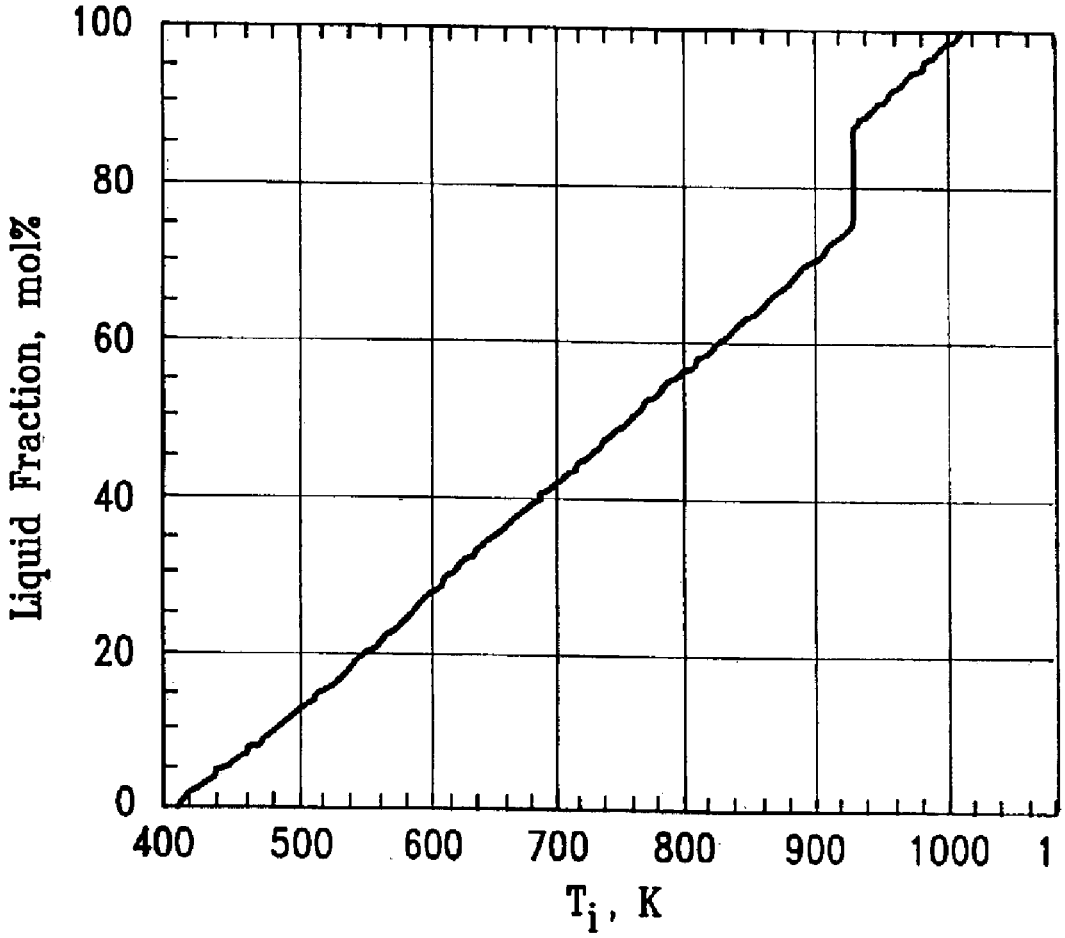
FIG. 1 is a graph showing the relationship between the initial reaction temperature and the quantity of liquid fraction in a semisolid combustion product.

In accordance with the present invention, combustion synthesis is conducted in a modified semi-solid metalworking machine. Right after the combustion reaction, the high temperature, semi-solid or liquid reaction products are quickly shaped and densified by semi-solid metalworking techniques. In this manner, a wide variety of intermetallics, ceramics, and their composites can be economically produced with high density, fine microstructure, and a near net shape that is, or is close to, a desired shape requiring little or no subsequent machining.

The initial constituents for use in preparation of products include suitable reactants (e.g. metallic and non-metallic elements and compounds), alloying elements, diluents (e.g. the reaction products), or reinforcements (e.g. ceramic particles). The reactant and additive powders are admixed, then compressed to form a simple shape compacted billet or "green compact". While the relative density of the compacted billet is not absolutely critical, the billet should be dense and strong enough for handling, but should not be so dense that it inhibits degassing. For a given powder mixture, the suitable relative density could be readily determined by experiments. Generally, the relative density of compacted billet is on the order of about 50% to about 90%, more preferably about 65% to about 85%, of the theoretical full density.

If necessary, the compacted billet is degassed prior to combustion synthesis. After degassing, the billet is then ignited to carry out a combustion synthesis. Various ignition techniques can be used to trigger a combustion reaction. Depending on the reaction system, a combustion synthesis can proceed in thermal explosion mode or self-propagating high-temperature synthesis (SHS) mode. In the thermal explosion mode, the whole billet will be uniformly heated up to the ignition temperature, then combustion synthesis takes place throughout the billet essentially simultaneously. If the SHS mode is used, the billet is first uniformly preheated to a temperature, then ignited at one end or multiple ends using intensive heating sources such as tungsten heating coils or laser beams or induction heating coils. The degassing and combustion synthesis can be performed directly inside the injection chamber of the pressure die casting machine or the press die of a forging machine. Alternatively, degassing and combustion synthesis can be performed outside the injection chamber or press die. In this case, the billet should be rapidly transferred to the injection chamber or press die after or during combustion synthesis.

In accordance with the present invention, the billet will preferably be in a semi-solid state after combustion synthesis, though the principle will apply to liquid reaction products also. In a semisolid state, the liquid fraction in the billet is generally greater than 10 vol % of the liquid fraction as between 10–90 vol % of the liquid fraction and preferred to be in the range of 30–90 vol % depending on its mechanical properties. A key issue in the present invention is the acquisition of semisolid reaction product and the control of the liquid fraction. Depending on the particular combustion synthesis system which is used, the liquid fraction in the reaction product can be controlled by a) changing the initial reaction temperature or b) changing the amount of non-reacted additives such as alloying elements, diluents, and reinforcements; c) adding other more exothermic reacted additives to the system; and d) inputting extra thermal energy to the system by rapid heating such as induction heating or microwave heating. As an example, the art of liquid fraction control in a 3Ni+Al reaction system will be shown herein below.

To produce $Ni_3Al$ intermetallics a mixture of elemental Ni and Al powders undergoes a combustion synthesis. Depending on the initial reaction temperature and the amount of diluent or reinforcement, the liquid fraction in the product of combustion synthesis changes. FIG. 1 shows the effect of the initial reaction temperature on the liquid fraction in the semisolid combustion reaction product. By changing the initial reaction temperature, the liquid fraction can be controlled. At a fixed initial reaction temperature, the liquid fraction can further be changed by adding certain amount of end product $Ni_3Al$ to the reactant mixture.

Figure 2:
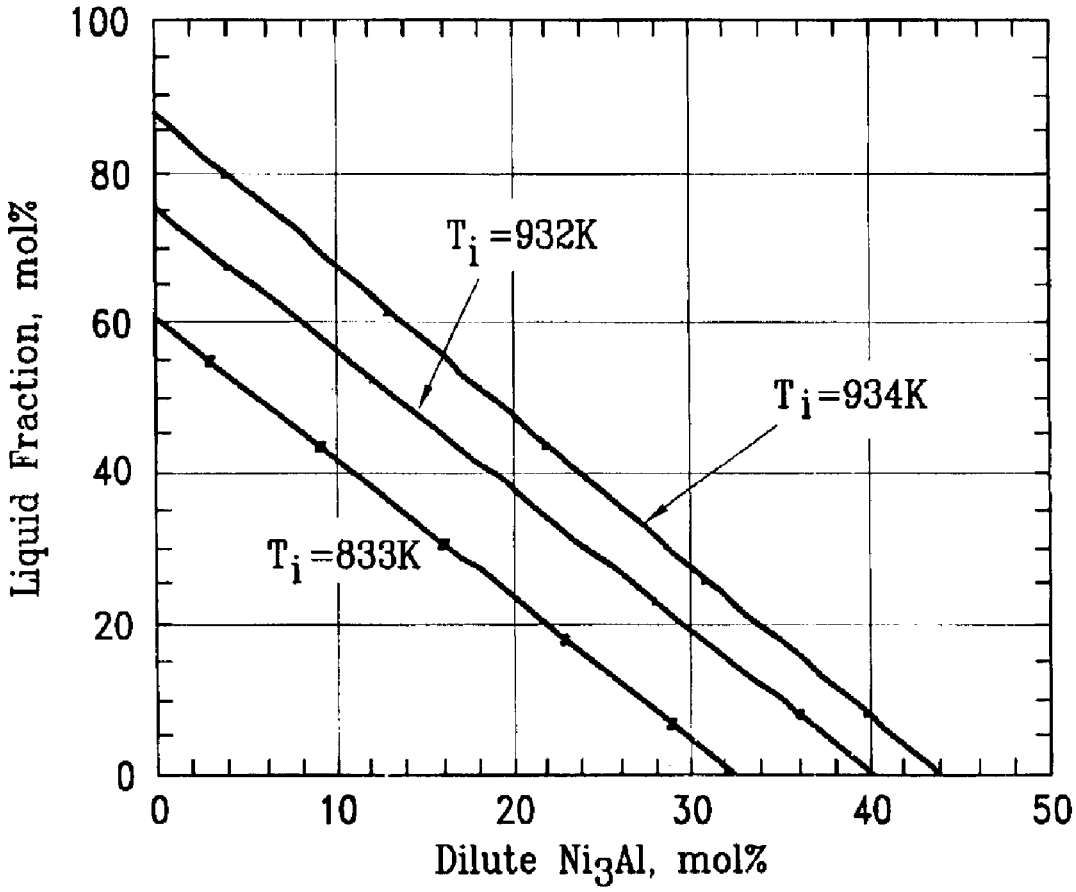
FIG. 2 is a graph showing the relationship of between the amount of diluent and the quantity of liquid fraction.

FIG. 2 shows the relationship between the amount of diluent $Ni_3Al$ and the liquid fraction. For example, for an initial reaction at a temperature of 833°K the liquid fraction in the combustion reaction product can be lowered from 60 mol % to 42 mol % by addition about 10 mol % end product $Ni_3Al$ to the mixture. The liquid fraction can also be changed by adding ceramic reinforcement to the reacting mixture. For example as shown in FIG. 3, the liquid fraction is lowered by adding $Al_2O_3$ to the reacting mixture.

Figure 3:
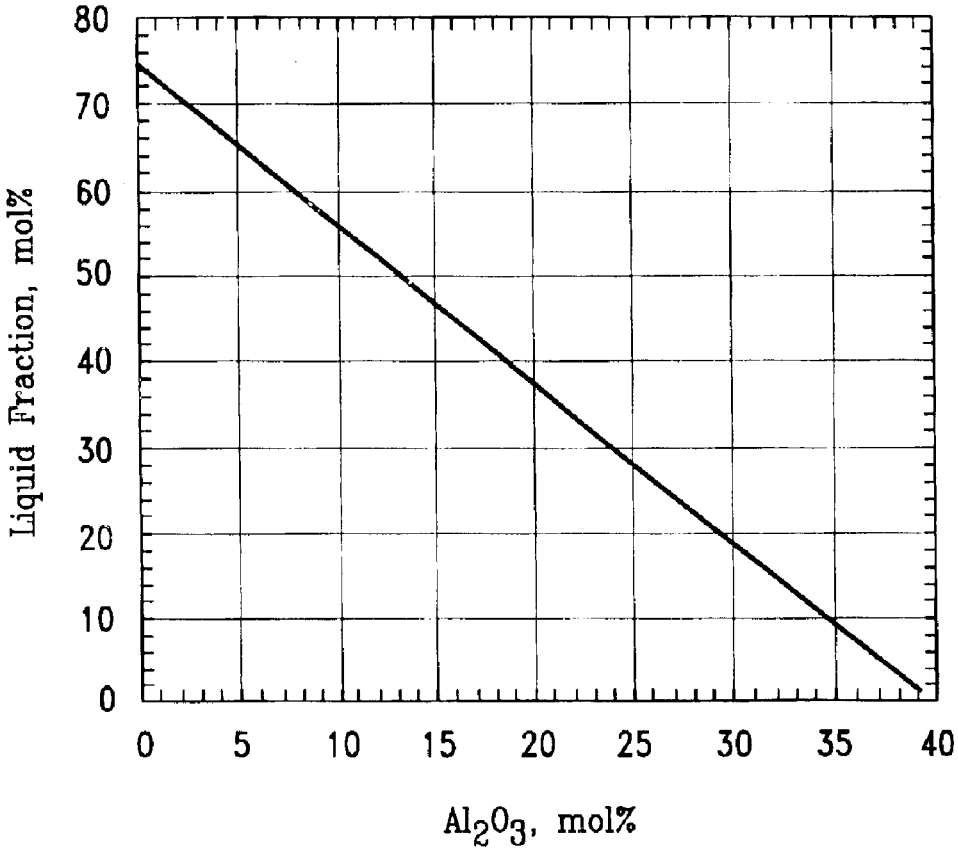
FIG. 3 is a graph showing the effect of a ceramic reinforcement on the quantity of liquid fraction.

The above results as shown in FIGS. 1–3 were obtained by thermodynamic calculation under the assumption of adiabatic condition. In practice, the thermal transfer between the reaction system and its environment will affect the liquid fraction. Though it is feasible to change the thermal transfer condition for the control of liquid fraction, it is preferred to minimize the thermal transfer to avoid non-uniform temperature distribution. Fortunately, it is not difficult to minimize the thermal transfer by taking advantage of the fast characteristics of both combustion synthesis and semisolid forming processes, and by using proper thermal insulation.

Figure 4:
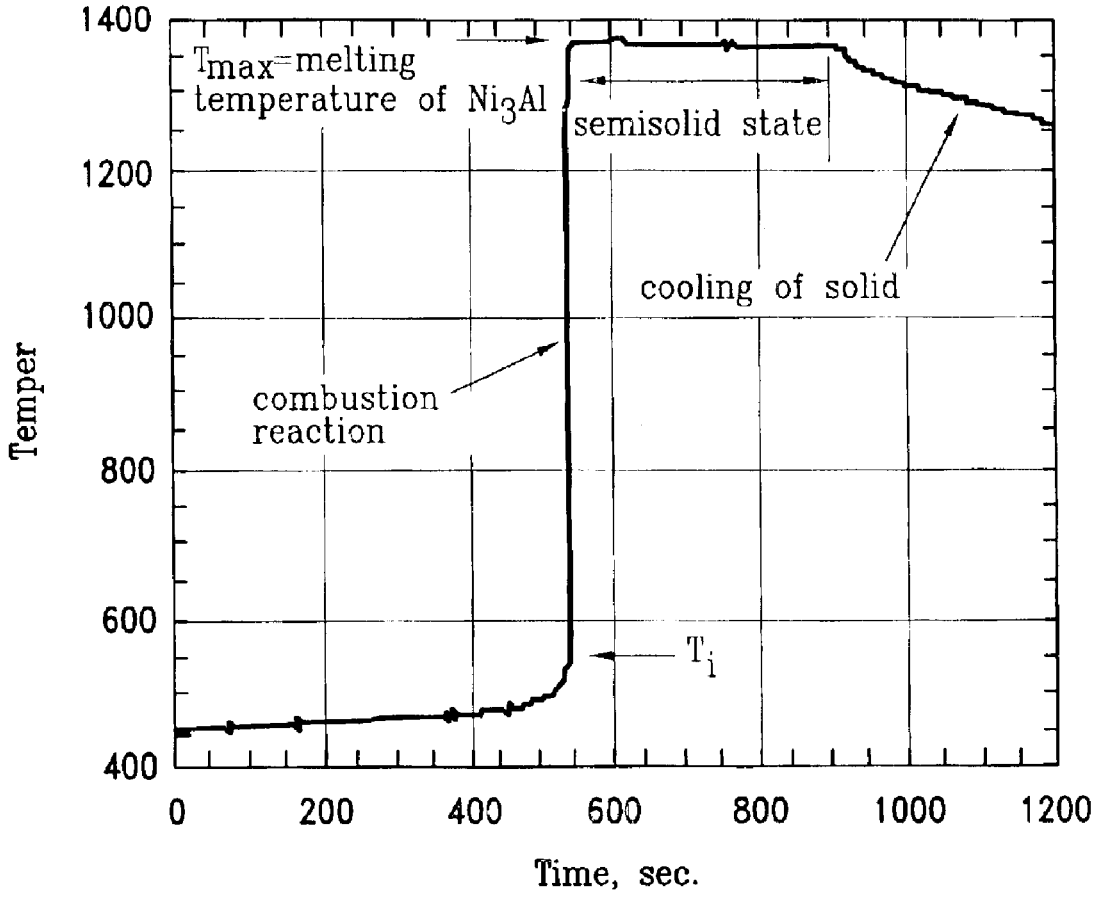
FIG. 4 is a graph showing a typical temperature history of a green compact (3Ni+Al) undergoing combustion synthesis.

For example, FIG. 4 shows a recorded temperature history of a billet (green compact) undergoing a combustion synthesis but without semisolid forming. The combustion synthesis is performed in a thermal explosion mode in vacuum of about 0.1 Torr. A 63.6 mm diameter and 65.5 mm height compacted billet having a 72% relative density is used in this example. It is noted that the temperature of the billet rises from the ignition temperature $T_1$ (about 580° C.) to a maximum temperature $T_{max}$ (1365° C.) within 0.1 second. Afterwards, the temperature of the billet stays at 1365° C. for about 355 seconds. In this period, the billet is in the semisolid state with about 60 mol % liquid at the beginning and 0 mol % liquid at the end. Since the semisolid forming process can be started without much difficulty within a short period of time (e.g. 5 seconds) after the reaction system reaches its maximum temperature the liquid fraction of the billet is still approximately 60 mol % right before the semisolid forming process starts.

Once a semisolid billet is produced by combustion synthesis, its semisoid/thixotropic forming process is quite straightforward. For example, considering the high temperature of billets, a forming process using a die should be fast enough to avoid complete solidification before the die is totally filled. For different products, the moving speed of ram of the forming machine could be readily determined experimentally. It is possible that the forming process may be conducted under a normal atmosphere or an inert environment to prevent oxidation of the materials. However, both the combustion synthesis and the semisolid forming process can be conducted under vacuum to avoid excessive oxidation and to remove trapped gasses thus removing voids and creating a more dense article. Vacuum levels less than 1 Torr are suitably employed. After forming, the shaped articles are removed from the die chamber. The whole process including combustion synthesis and semisolid forming can be complete within 60 seconds.

Figure 5A:
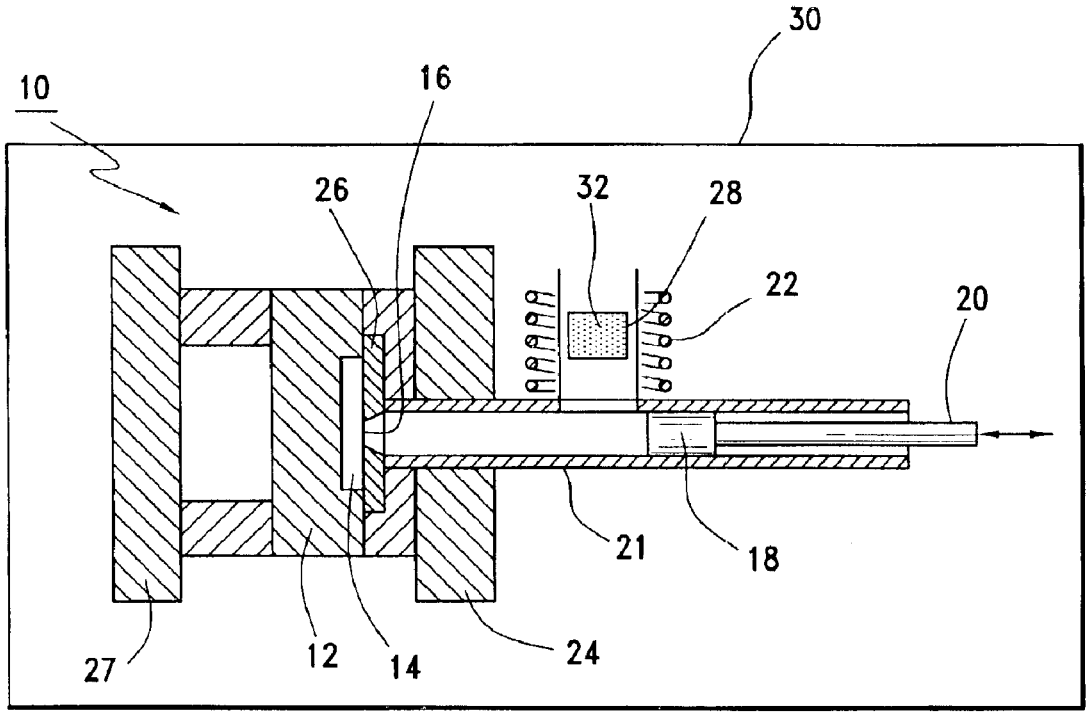
FIGS. 5*a* and 5*b* are schematic views showing an apparatus arrangement according to the present invention for carrying out the method of the present invention.

A combustion synthesis and semisolid forming apparatus according to the present invention is illustrated in FIG. 5*a*. As shown in FIG. 5*a*, the apparatus generally indicated at 10 includes a die 12 having a die cavity 14 with an injection orifice 16. Located adjacent the die cavity 14 is a ram 18. The ram is carried by a rod 20 and is movable in a shot sleeve 21. The rod is biased so as to locate the ram across the open end of the mold cavity as shown in FIG. 5. The apparatus can be arranged horizontally or vertically. Disposed adjacent the shot sleeve containing the ram is a heater 22. The heater may be any heating device capable of providing the temperatures required for preheating and initiating the combustion synthesis. For example suitable heating devices include radiant heaters, tungsten heating coils, laser beams, and fuel burning heaters among others.

Above the die cavity 14 is a stationary platen 24 and a mold member 26. The ram 18 is arranged to be driven towards the die so as to forcibly drive the billet through the orifice in the mold member 26 and into the mold cavity. A movable platen 27 can be moved during the molding process. Completing the structure is an optional sensor 28 for monitoring the temperature of a green billet. A suitable sensor is a tungsten rhenium thermocouple. The apparatus as shown in FIG. 5 may be wholly or partly located in a chamber 30 that can be sealed and evacuated to facilitate the formation of a relatively dense semisolid product.

For purposes of demonstrating the method of the present invention, an intermetallic $Ni_3Al$ article was produced by first weighing out 885 grams nickel powder and 136 grams aluminum powder for a desired $Ni_3Al$ composition. The nickel was an INCO Nickel powder Type 123 that was obtained from Novamet, Wyckoff, N.J. and the aluminum was a Type H-15 that was obtained from Valimet Inc., Stockton, Calif.

The weighed powders were then mixed in a plastic vial with methacrylate mixing balls for 15 minutes. After mixing, the powder mixture was placed in a die and was compressed under a pressure of about 250 MPa to form a green compact. The result was a cylindrical billet about 63.6 mm in diameter and about 65.5 mm in height with a relative density of about 72%.

The billet then was transferred to the apparatus shown in FIG. 5*a*. After placement, the chamber 30 was evacuated to about 0.1 Torr and then the heater 22 was activated to provide a heating rate of about 30° C./min. The sensor 28 monitored the temperature of the billet 32 during heating. When the temperature of the billet reached about 580° C., the combustion synthesis started in a thermal explosion mode. Within a fraction of a second, the temperature of the billet reached a maximum of about 1365° C. and the billet was transformed to a semisolid. The semisolid billet included a liquid fraction but substantially retained its shape and could be moved or otherwise manipulated if necessary without collapsing. After the billet reached the maximum temperature, the heater was shut off. Depending upon the configuration of the apparatus and the heater it may be necessary to move the heater 22 so as not to have it interfere with the subsequent operations.

The hot semisolid billet 32 was moved by gravity into the shot sleeve and was held for about four seconds and then the rod 20 was moved at a high speed of about 1 m/sec. This forces the ram 18 against the billet and moves the billet into the die cavity 14. The force exerted by the ram against the semisolid billet subjected the billet to a high shear rate. The resulting low friction allowed the billet to assume the shape of the die cavity under the pressing force of the movable platen 27. After a preset maximum load of about 80 tons was reached, the load was held for about ten seconds and then was released. Moving the platen 27 allowed the shaped article to be ejected from the die cavity. The shaped article, being formed by forcing it into conformity with the shape of the mold cavity was made the desired, or close to the desired shape so as to require little or no subsequent machining.

Figure 5B:
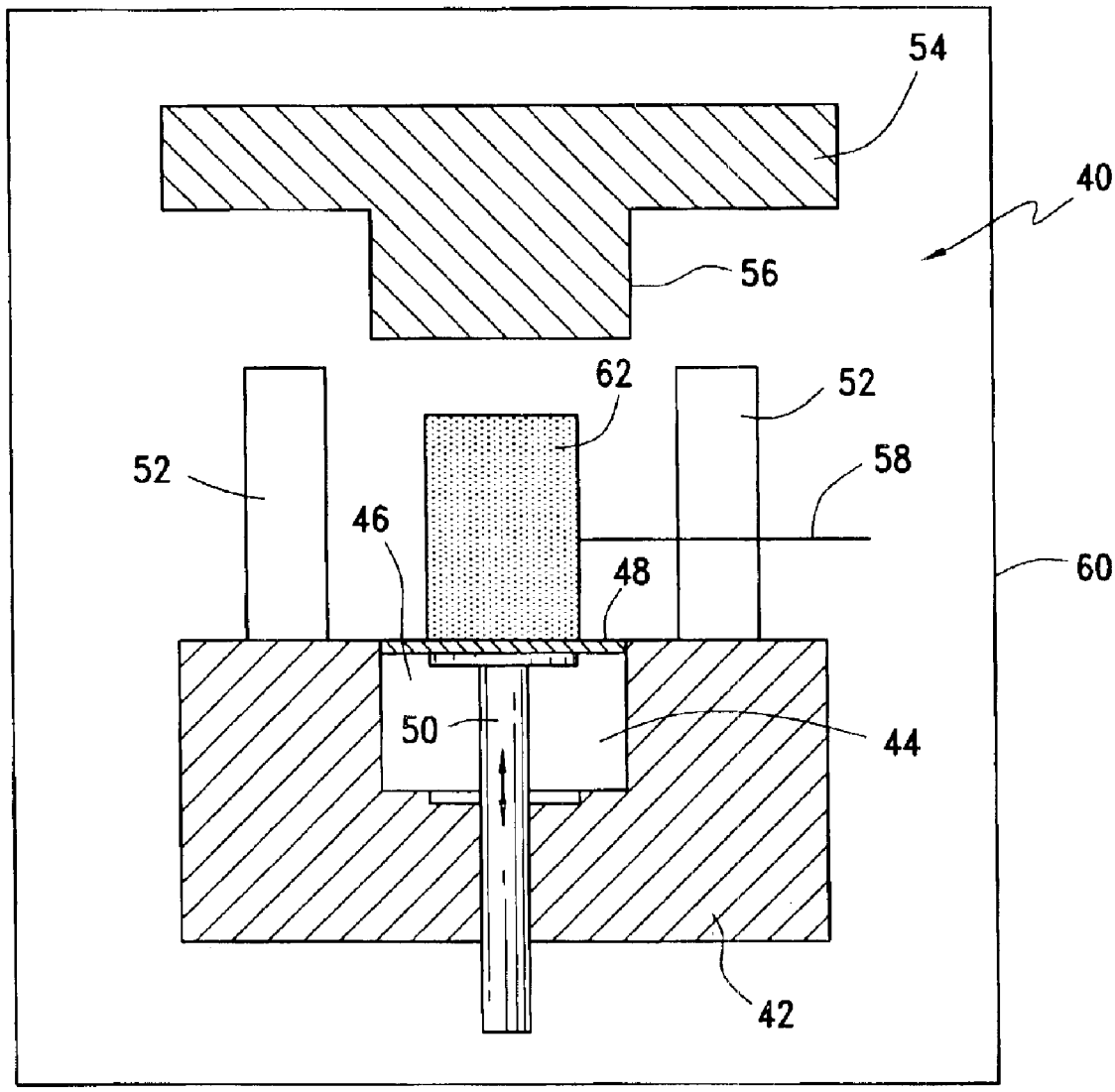

An alternative embodiment of a forming apparatus 40 is shown in FIG. 5*b*. As shown in FIG. 5*b*, the apparatus generally indicated at 40 includes a die 42 having a mold cavity 44 open at its top 46. Located in the mold cavity 44 is a support plate 48. The plate is carried by a rod 50 and is movable in the cavity. In this respect the rod is biased so as to locate the support plate across the open end of the mold cavity 44.

Above the mold cavity 44 is a press 54 having a punch member 56 shaped to mate with the mold cavity. The press 54 is arranged to be driven downwardly towards the die so as to forcibly drive the punch member 56 into the mold cavity. Completing the structure is a sensor 58 for monitoring the temperature of a work piece located on the support plate 48. A suitable sensor is a tungsten rhenium thermocouple. The apparatus as shown in FIG. 5*b* may be wholly or partly located in a chamber 60 that can be sealed and evacuated to facilitate the formation of a relatively dense semisolid product.

The weighed powders are mixed as they were for the first apparatus 5*a*. After mixing, the powder mixture is placed in a die and is compressed under a pressure of about 250 Mpa to form a green compact. The result is a cylindrical billet about 63.6 mm in diameter and about 65.5 mm in height with a relative density of about 72%.

The billet then is transferred to the apparatus shown in FIG. 5*b*. In this respect, FIG. 5*b* shows the billet 62 placed on the vertically movable support plate 48. After placement on the support plate, the chamber 60 is evacuated to about 0.1 Torr and then the heater 52 is activated to provide a heating rate of about 30° C./min. The sensor 58 monitors the temperature of the billet 52 during heating. When the temperature of the billet reaches about 580° C., the combustion synthesis starts in a thermal explosion mode. Within a fraction of a second, the temperature of the billet reaches a maximum of about 1365° C. and the billet is transformed to a semisolid. As was discussed above, the semisolid billet includes a liquid fraction but substantially retains its shape and can be moved or otherwise manipulated if necessary without collapsing. After the billet reaches the maximum temperature, the heater is shut off. Depending upon the configuration of the apparatus and the heater it may be necessary to move the heater 52 so as not to have it interfere with the subsequent operation of the press 54.

Figure 6A:
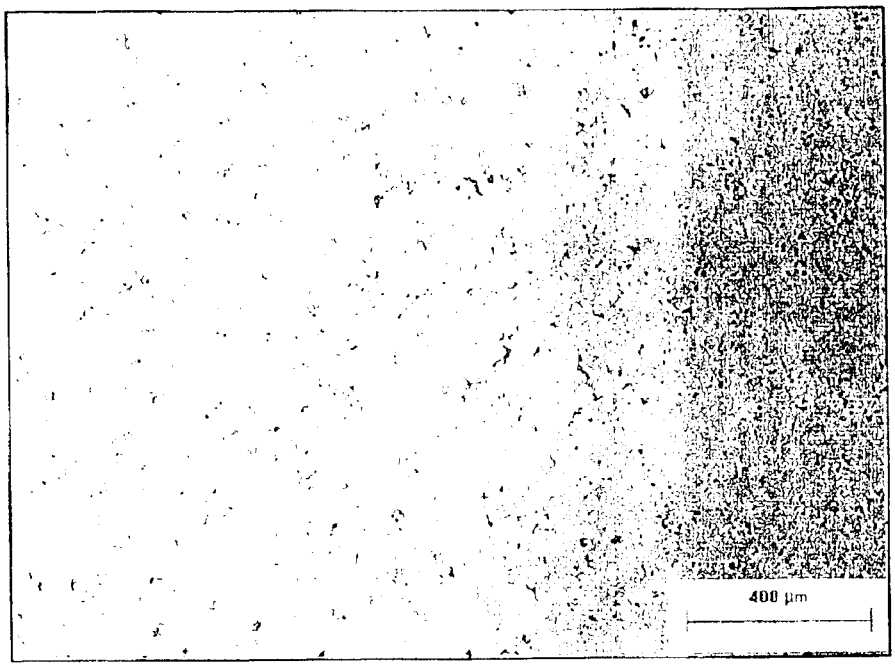
FIGS. 6*a* and 6*b* are two micrographs of a polished product showing dense $Ni_3Al$ with a small amount of oxide strings.
Figure 6B:
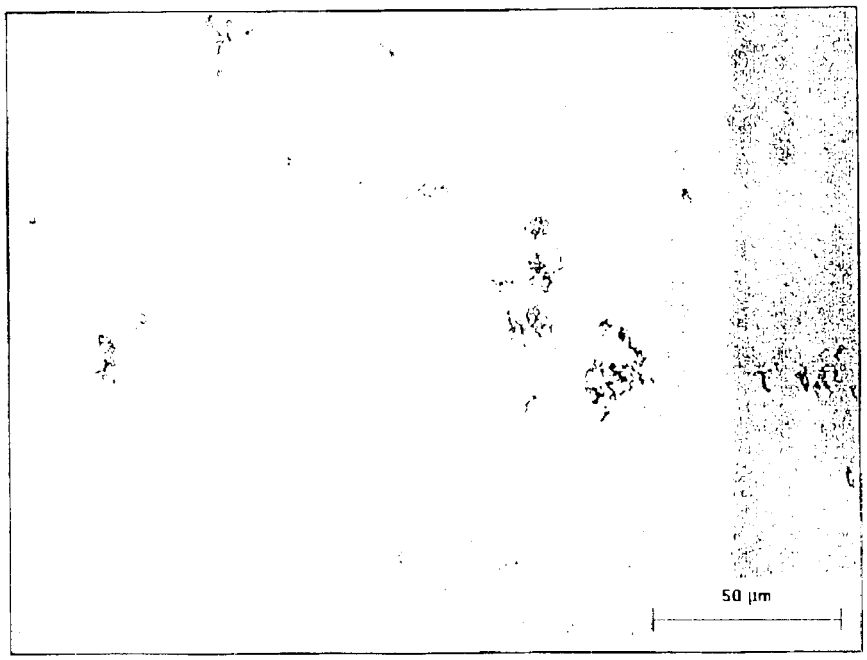

In this embodiment, the hot semisolid billet 62 is held for about four seconds and then the press 54 is moved downwardly at a high speed of about 1 m/sec. This forces the punch 56 against the billet and moves the billet and support plate 48 against the bias of the rod 50 and into the mold cavity 44. The force exerted by the press and punch against the semisolid billet subjects the billet to a high shear rate. The resulting low friction allows the billet to assume the shape of the mold cavity under the pressing force of the punch 56. After a preset maximum load of about 80 tons is reached, the load is held for about ten seconds and then is released. Lifting the press allows the bias of the rod 50 to return the support plate and the shaped article it now carries back to the level shown in FIG. 5*b* so that the shaped article is ejected from the mold cavity. The shaped article, being formed by forcing it into conformity with the shape of the mold cavity is made the desired, or close to the desired shape so as to require little or no subsequent machining. FIGS. 6*a* and 6*b* are two micrographs of a polished product showing dense $Ni_3Al$ with a small amount of oxide strings.

Figure 7:
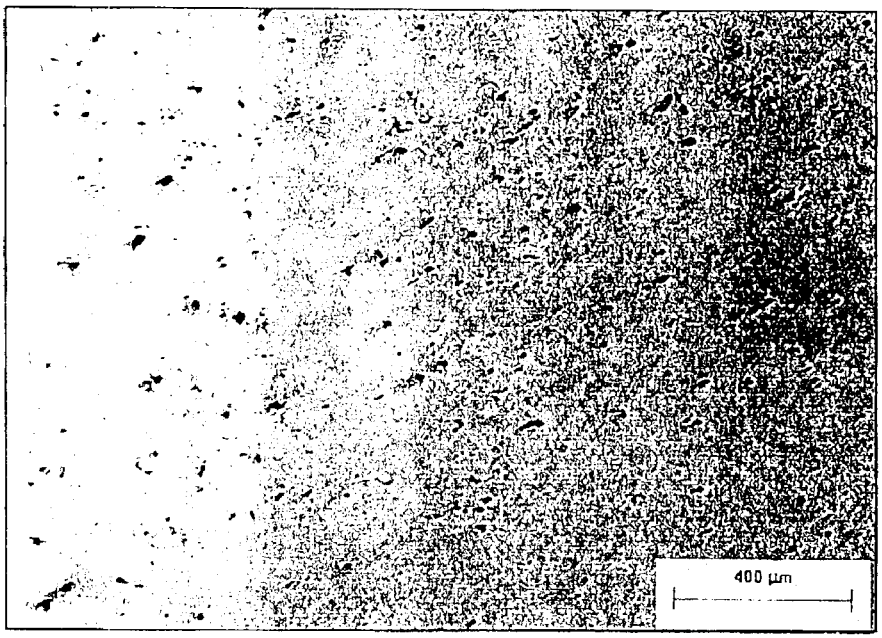
FIG. 7 is a micrograph showing a polished product produced by combustion synthesis only (without semisolid forming)

FIG. 7 is a micrograph showing a polished product produced by combustion synthesis only (without semisolid forming).

Figure 8:
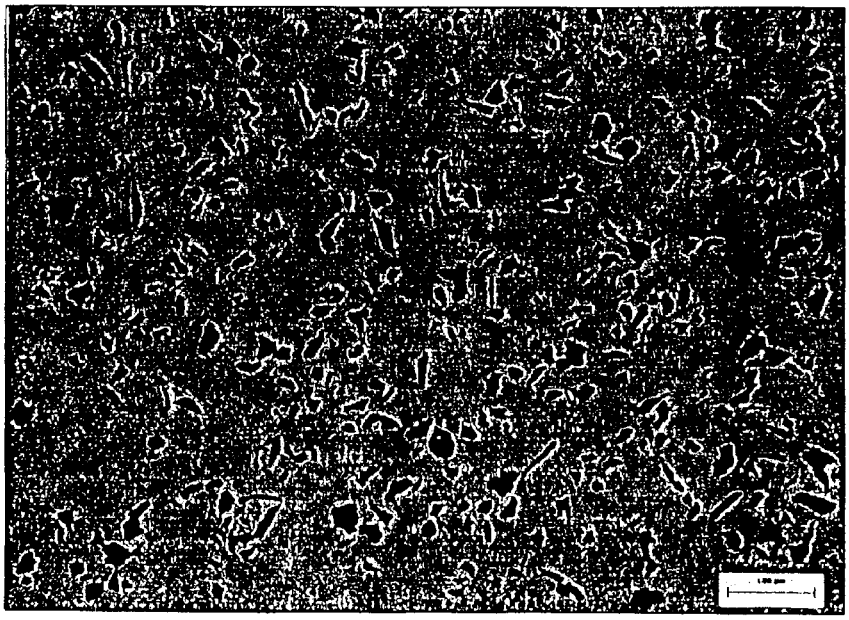
FIG. 8 is a micrograph showing the microstructure of $Al_2O_3/Ni_3Al$ composite.

FIG. 8 is a micrograph showing the microstructure of $Al_2O_3/Ni_3Al$ composite.

Figure 9A:
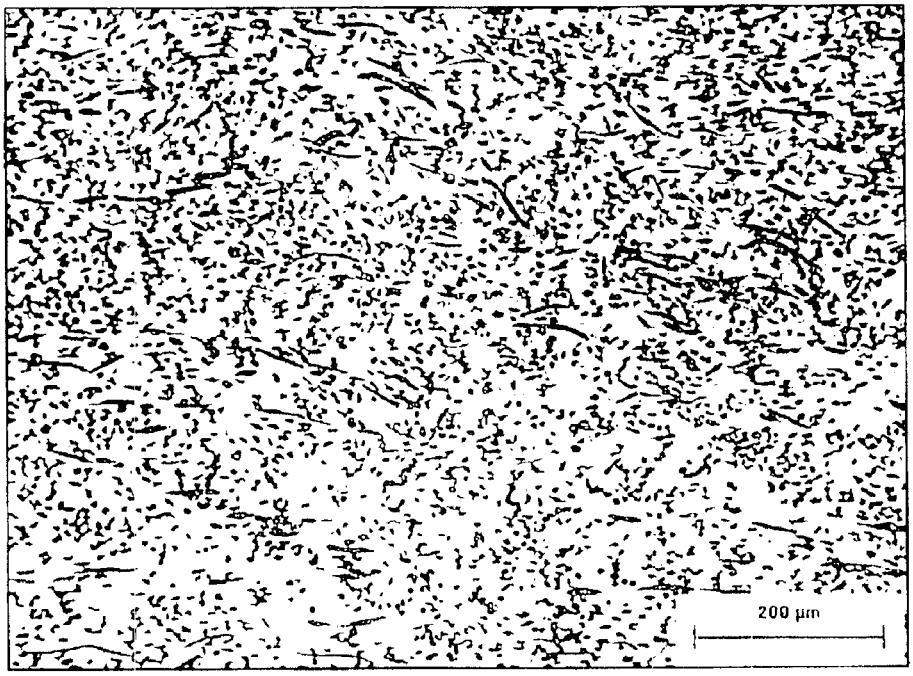
FIGS. 9*a* and 9*b* are two micrographs showing the microstructure of a $ZrO_2/Ni_3Al$ composite.
Figure 9B:
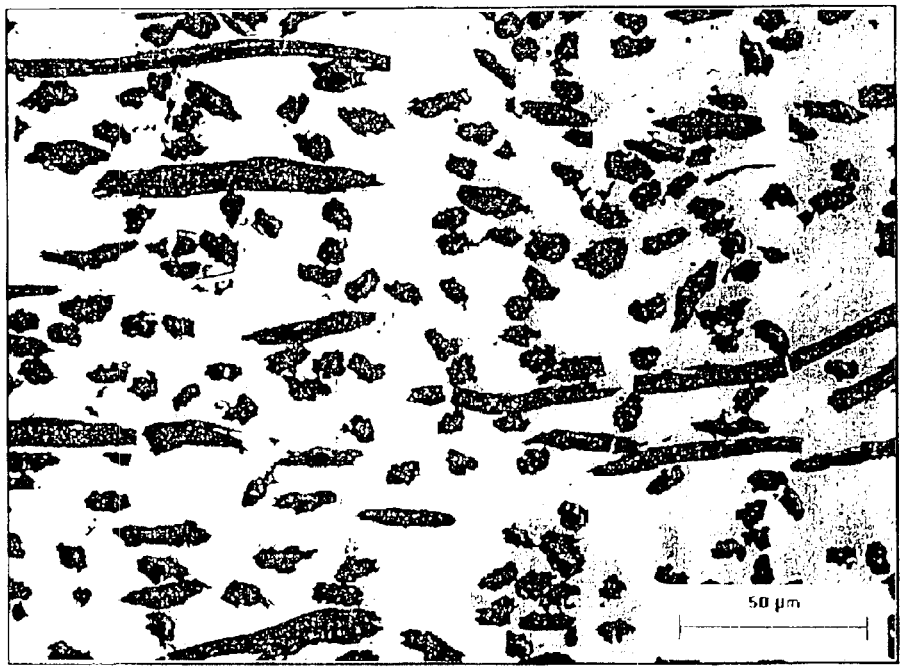

FIGS. 9*a* and 9*b* are two micrographs showing the microstructure of a $ZrO_2/Ni_3Al$ composite.

EXAMPLE 1

An intermetallic $Ni_3Al$ article was produced by the following series of steps.

1) 885 gram nickel powder (INCO Nickel Powder Type 123, Novamet, Wyckoff, N.J.) and 136 gram aluminum powder (Type H-15, Valimet Inc., Stockton, Calif.) were weighed for a desired composition $Ni_3Al$.
2) The weighed powders were mixed in a plastic vial with methacrylate mixing balls for 15 minutes.
3) The powder mixture was compressed in a die under a pressure of 250 MPa to obtain a billet of 63.6 mm diameter and 65.5 mm height. The relative density of the billet was 72%.
4) As shown in FIG. 5, the billet was heated up by induction heating at a heating rate of 30° C./min. Before heating the whole chamber was evacuated to about 0.1 Torr.
5) During heating up, the temperature of the billet was monitored by a thermocouple. When the temperature of the billet reached about 580° C., the combustion synthesis reaction started in a thermal explosion mode, and the temperature of the billet reached the maximum (~1365° C.) within a fraction of second.
6) After the billet reached the maximum temperature, the hot semi-solid billet was then quickly transferred to the shot sleeve and injected into the die cavity at a high ram speed of 1 m/s. After the preset maximum pressure of 300 MPa was reached and held for about 10 seconds, the load was released, and the shaped article was then ejected from the die cavity.

The product was completely densified as shown in the micrographs of polished product in FIG. 6. No voids are discerned. The product consists of dense $Ni_3Al$ and small amount of oxide strings which come from raw powder reactant or formed during the processes. In comparison, the micrograph of the polished sample produced by combustion synthesis only (without semi-solid forming) is presented in FIG. 7. Obviously many voids exist in the sample.

EXAMPLE 2

An $Al_2O_3$ particle reinforced $Ni_3Al$ matrix composite article was produced by the following series of steps.

1) 720 gram nickel powder (INCO Nickel Powder Type 123, Novamet, Wyckoff, N.J.), 107 gram aluminum powder (Type H-5, Valimet Inc., Stockton, Calif.), and 45 gram $Al_2O_3$ particles (Type Al-602, Atlantic Equipment Engineers, Bergenfield, N.J.) were weighed for a desired composition 90 mol % $Ni_3Al$+10 mol % $Al_2O_3$.
2) The weighed powders were mixed in a plastic vial with methacrylate mixing balls for 20 mins.
3) The powder mixture was compressed in a die under a pressure of 250 MPa to obtain a billet of 63.6 mm diameter and 56.2 mm height. The relative density of the billet was 74.4%.
4) As shown in FIG. 5, the billet was heated up by induction heating at a heating rate of 30° C./min. Before heating the whole chamber was evacuated to about 0.1 Torr.
5) During heating up, the temperature of the billet was monitored by a thermocouple. When the temperature of the billet reached about 580° C., the combustion synthesis reaction started in a thermal explosion mode, and the temperature of the billet reached the maximum (~1365° C.) within a fraction of second.

After the billet reached the maximum temperature, the hot semisolid billet was then quickly transferred to the shot sleeve and injected into the die cavity at a high ram speed of 1 m/s. After the preset maximum load of 300 MPa was reached and held for about 10 seconds, the load was released, and the shaped article was then ejected from the die cavity.

The microstructure of the composite is shown in FIG. 8. Similarly $ZrO_2$ reinforced $Ni_3Al$ composite was produced too. The microstructure of $ZrO_2/Ni_3Al$ are presented in FIG. 9. Again we can see that the material is dense, free of voids. The distribution of the reinforcements (SiC and $ZrO_2$) is uniform. Traditionally intermetallics matrix composites are produced by powder metallurgy which involves high temperature, long periods, and high cost densification processes. The present invention avoids high temperature facilities and high cost processing and provides simplicity, flexibility and speed in manufacture of these composites.

EXAMPLE 3

An intermetallic NiAl article was produced by the following series of steps.

1) 548 gram nickel powder (INCO Nickel Powder Type 4SP 10–20, Novamet, Wyckoff, N.J.) and 252 gram aluminum powder (Type H-15, Valimet Inc., Stockton, Calif.) were weighed for a desired composition NiAl.
2) The weighed powders were mixed in a plastic vial with methacrylate mixing balls for 15 mins.
3) The powder mixture was compressed in a die under a pressure of 180 MPa to obtain a billet of 63.6 mm diameter and 65 mm height. The relative density of the billet was 75%.
4) As shown in FIG. 5, the billet was heated up at a heating rate of 30° C./min. Before heating the whole chamber was evacuated to about 0.1 Torr.
5) During heating up, the temperature of the billet was monitored by a thermocouple. When the temperature of the billet reached about 530° C., the combustion synthesis reaction started in a thermal explosion mode, and the temperature of the billet reached the maximum (~1640° C.) within a fraction of second.
6) After the billet reached the maximum temperature, the hot billet was then quickly transferred to the shot sleeve and injected into the die cavity at a high ram speed of 1 m/s. After the preset maximum load of 30 MPa was reached and held for about 10 seconds, the load was released, and the shaped article was then ejected from die cavity.

In this example the product of combustion synthesis is a liquid so the later forming process is then similar to die casting or liquid forging. But the present invention avoids high temperature facilities and provides speed and low cost processing.

EXAMPLE 4

A $Ni_{0.59}Al_{0.41}$ article was produced by the following series of steps.

1) 600 gram nickel powder (Type Ni-122, Atlantic Equipment Engineers, Bergenfield, N.J.) and 194 gram aluminum powder (Type H-60, Valimet Inc., Stockton, Calif.) were weighed for a desired composition $Ni_{0.59}$ $Al_{0.41}$.
2) The weighed powders were mixed in a plastic vial with methacrylate mixing balls for 15 mins.
3) The powder mixture was compressed in a die under a pressure of 180 MPa to obtain a billet of 63.6 mm diameter and 53.5 mm height. The relative density of the billet was 82%.
4) As shown in FIG. 5, the billet was heated up by induction heating at a heating rate of 30° C./min. Before heating the whole chamber was evacuated to about 0.1 Torr.
5) During heating up, the temperature of the billet was monitored by a pyrometer. When the temperature of the billet reached about 615° C., the combustion synthesis reaction started in a thermal explosion mode, and the temperature of the billet reached the maximum (~1590° C.) within a fraction of second.
6) After the billet reached the maximum temperature, the hot billet was then quickly transferred to the shot sleeve and injected into the die cavity at a high ram speed of 1 m/s. After the preset maximum load of 30 MPa was reached and held for about 10 seconds, the load was released, and the shaped article was then ejected from die cavity.

This example shows the flexibility of intermetallic composition and hence the possibility of making other high temperature materials. Although the time of 10 seconds is sufficient for all these examples, the actual time may have to be changed for each individual situation depending on the rate of cooling.

Thus it should be appreciated that the present invention accomplishes its intended objects in providing a method and apparatus for manufacturing an article composed of high temperature materials that is sufficiently close to a desired shape as to require little or no subsequent machining. The method uses combustion synthesis to bring a billet of compressed reactant powders to a semisolid state so the billet can be formed to the desired shape by pressure molding.

While the invention has been described in detail, it should be understood that modifications are well within the skill of the art. For example, the heating and forming operations can take place at different locations. In this case the semisolid billet is moved from a heating chamber to a forming chamber. The billet can be moved by any suitable means (not shown) such as a movable grasping arm, a pusher or conveyor. The heater may be an oven having an inlet and an outlet and wherein the green billet is heated during passage through the oven to the forming chamber. Having described the invention in detail, what is claimed is:

What is claimed is:

1. Apparatus for forming a near net shape dense article comprising:

a heating chamber for combustion synthesis of a green body;

a shot sleeve communicating with the heating chamber for receiving a synthesized billet;

a ram movable in the shot sleeve; and a die cavity in communication with the shot sleeve for receiving the synthesized billet.

2. The apparatus of claim 1 in which the heating chamber and the shot sleeve are arranged so that the synthesized billet moves from the heating chamber into the shot sleeve by the force of gravity.

3. The apparatus of claim 1 in which the die cavity comprises a movable die.

4. The apparatus of claim 3 comprising a movable platen connected to the movable die.

5. The apparatus of claim 1 comprising an injection orifice between the shot sleeve and the die cavity.

6. The apparatus of claim 1 comprising a temperature sensor coupled to the heating chamber.

7. The apparatus of claim 1 in which the heating chamber comprises a radiant heater.

8. The apparatus of claim 1 in which the heating chamber comprises an induction heater.

9. The apparatus of claim 1 in which the heating chamber comprises a fuel burning heater.

10. The apparatus of claim 1 in which the heating chamber comprises a laser heater.

11. The apparatus of claim 1 comprising a vacuum chamber enclosing the heating chamber, shot sleeve and die cavity.

12. Apparatus for forming a near net shape dense composite comprising:

a heating chamber for combustion synthesis of a green body to form a billet;

a mold cavity communicating with the heating chamber;

a support plate movable between the heating chamber and the mold cavity; and a press movable into position relative to the mold cavity for compressing the billet.

13. The apparatus of claim 12 in which the support plate is movable between a position forming a wall of the mold cavity and a position forming a wall of the heating chamber.

14. The apparatus of claim 13 in which the support plate is mounted on a support member for reciprocal movement.

15. The apparatus of claim 14 in which the support member is biased to a position in which the support plate is in the position forming a wall of the heating chamber.

16. The apparatus of claim 15 in which the press moves the support to the position forming a wall of the mold cavity.

17. The apparatus of claim 13 in which the press comprises a punch member.

* * * * *